US006211659B1

(12) United States Patent
Singh

(10) Patent No.: US 6,211,659 B1
(45) Date of Patent: Apr. 3, 2001

(54) CASCODE CIRCUITS IN DUAL-$V_T$, BICMOS AND DTMOS TECHNOLOGIES

(75) Inventor: Surinder P. Singh, Hillsboro, OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 09/525,343

(22) Filed: Mar. 14, 2000

(51) Int. Cl.[7] ..... G05F 3/16
(52) U.S. Cl. ..... 323/315
(58) Field of Search ..... 323/312, 313, 323/315; 330/257, 288; 327/535, 538, 540

(56) References Cited

U.S. PATENT DOCUMENTS

| | | | | |
|---|---|---|---|---|
| 4,096,517 | | 6/1978 | Hinn | 358/40 |
| 4,533,877 | | 8/1985 | Rahim | 330/253 |
| 4,583,037 | | 4/1986 | Sooch | 323/315 |
| 4,983,929 | | 1/1991 | Real et al. | 330/288 |
| 5,099,205 | | 3/1992 | Lewyn | 330/288 |
| 5,142,696 | | 8/1992 | Kosiec et al. | 455/260 |
| 5,248,932 | | 9/1993 | Prentice | 323/315 |
| 5,311,115 | | 5/1994 | Archer | 323/315 |
| 5,341,109 | | 8/1994 | Ryat | 330/288 |
| 5,359,296 | | 10/1994 | Brooks et al. | 330/288 |
| 5,361,006 | * | 11/1994 | Cooperman et al. | 326/73 |
| 5,444,363 | * | 8/1995 | Cabler | 323/315 |
| 5,512,815 | | 4/1996 | Schrader | 323/315 |
| 5,589,786 | * | 12/1996 | Bella et al. | 327/108 |
| 5,680,038 | | 10/1997 | Fiedler | 323/315 |
| 5,835,994 | | 11/1998 | Adams | 323/315 |
| 5,933,721 | | 8/1999 | Hause et al. | 438/217 |
| 5,966,005 | | 10/1999 | Fujimori | 323/315 |
| 5,982,676 | * | 11/1999 | Poplevine et al. | 365/189.05 |

OTHER PUBLICATIONS

Chang, M.H., et al., "A Highly Manufacturable 0.25 um Multiple– Vt Dual Gate Oxide CMOS Process for Logic/Embedded IC Foundry Technology", 1998 Symposium on VLSI Technology Digest of Technical Papers, 150–151, (Jun. 1998).

Chen, Z., et al., "0.18um Dual Vt MOSFET Process and Energy–Delay Measurement", *IEDM* 96–851, 1996 IEEE, 33.2.1–33.2.4, Apr. (1996).

* cited by examiner

*Primary Examiner*—Matthew Nguyen
(74) *Attorney, Agent, or Firm*—Schwegman, Lundberg, Woessner & Kluth, P.A.

(57) ABSTRACT

The various embodiments utilize cascode circuits in dual-threshold-voltage (dual-$V_T$), BiCMOS and DTMOS technologies. The circuit topologies include cascode-connected transistors in the output branch of a current mirror and as a cascode amplifier. Such configurations are capable of both high output impedance and high output swing. The cascode circuits of the various embodiments are operable without separate gate-bias voltages for the cascode-connected transistors. The current mirrors can be used in circuits requiring a regulated current or other current mirroring applications. The current mirrors can further be used as active loads, such as an active load for an amplifier.

33 Claims, 6 Drawing Sheets

CASCODE CIRCUITS IN DUAL-$V_T$, BICMOS AND DTMOS TECHNOLOGIES

TECHNICAL FIELD OF THE INVENTION

The invention relates generally to cascode circuits, and more particularly to methods and apparatus utilizing cascode-connected transistors in current mirrors, active loads and amplifiers, in conjunction with dual-threshold-voltage (dual-$V_T$), BiCMOS and DTMOS technologies.

BACKGROUND OF THE INVENTION

Cascode circuits have been used to buffer or isolate a first transistor from voltage variation by series connecting it with a second transistor. By such buffering, the performance of the first or protected transistor is improved. As used in current mirrors, cascoding tends to reduce the variation of current with applied voltage. Cascoding can also be used in amplifiers to decrease the Miller multiplication of the capacitance between the amplifier output and input.

Conventional current mirrors provide an output current proportional to, and often substantially equal to, an input or reference current. By separating the output current from the reference current on different branches or sides of the current mirror, the output current is available to drive high impedance loads. U.S. Pat. No. 5,311,115, issued May 10, 1994 to Archer, describes a variety of current mirrors and their operation.

While a variety of approaches have been taken, many suffer some drawback, such as low output impedance, high reference side voltage drop, need for depletion devices, temperature sensitivity, troublesome leakage currents, second-order effects, etc.

There remains a need for alternative cascode circuits for use in current mirrors and amplifiers.

DESCRIPTION OF THE EMBODIMENTS

In the following detailed description, reference is made to the accompanying drawings which form a part hereof, and in which is shown by way of illustration specific embodiments in which the invention may be practiced. These embodiments are described in sufficient detail to enable those skilled in the art to practice the invention, and it is to be understood that other embodiments may be utilized and that structural, logical and electrical changes may be made without departing from the spirit and scope of the invention. The following detailed description is, therefore, not to be taken in a limiting sense, and the scope of the invention is defined only by the appended claims and equivalents thereof. Like numbers in the figures refer to like components, which should be apparent from the context of use.

The various embodiments utilize cascode circuits in dual-threshold-voltage (dual-$V_T$), BiCMOS and DTMOS technologies. Dual-$V_T$ technology involves differing threshold voltages among the transistors of an integrated circuit. The circuit topologies disclosed herein include cascode current mirrors and amplifiers capable of both high output impedance and high output swing. The cascode current mirrors and amplifiers of the various embodiments are operable without separate gate-bias voltages for the cascode-connected transistors of the output branch. Such separate gate-bias voltages have been used in single-$V_T$ technology, i.e., transistors having the same threshold voltage, to keep both cascode-connected transistors in saturation. This type of separate gate-bias voltage can represent an undesirable overhead or current drain within the integrated circuit. Various embodiments are suited for use in current mirroring applications and as active loads, such as an active load for an amplifier. Embodiments are further suited for use as cascode amplifiers.

Dual-$V_T$ technology is being investigated as a means to reduce power dissipation in digital circuits. The differing threshold voltages can be produced using a variety of techniques, including differing implant dosing or energy, differing gate thicknesses, differing gate materials, etc. The various embodiments contained herein adapt the differential in transistor threshold voltages inherent in Dual-$V_T$ technology for use in analog circuits.

Figure 1A:
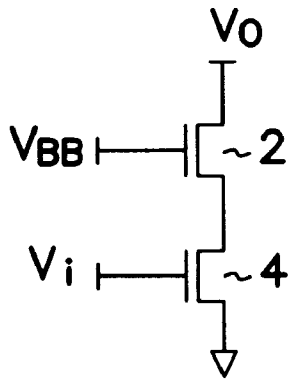
FIG. 1A (BACKGROUND ART)
FIGS. 1A–1B are schematics of cascode-connected transistors for use in the output branch of a current mirror or a cascode amplifier.
Figure 1B:
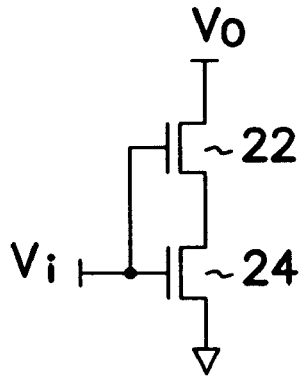
FIG. 1B (BACKGROUND ART)

FIGS. 1A–1B are schematics of cascode-connected transistors as used, for example, in the output branch of a current mirror or a cascode amplifier. Both circuits exhibit high output impedance due to the nature of the cascode connectivity. FIG. 1A has a first transistor 2 and a second transistor 4 in a single-$V_T$ technology. Accordingly, the first transistor 2 and the second transistor 4 have substantially the same threshold voltages.

The first source/drain terminal of the first transistor 2 is coupled to a first potential node, e.g., an output voltage node $V_o$, while its second source/drain terminal is coupled to the first source/drain terminal of the second transistor 4. The second source/drain terminal of the second transistor 4 is coupled to a second potential node, e.g., a ground node. The first transistor 2 and the second transistor 4 are thus coupled in series between a first potential and a second potential.

The gate of the first transistor 2 is coupled to a biasing voltage node $V_{BB}$ and the gate of the second transistor 4 is coupled to an input voltage node $V_i$. Because the first transistor 2 and the second transistor 4 have the same threshold voltage, $V_T$, the input voltage $V_i$ is generally incapable of maintaining both the first transistor 2 and the second transistor 4 in saturation. To facilitate saturation of the first transistor 2 and the second transistor 4, a biasing voltage $V_{BB}$ is applied to the gate of the first transistor 2. Several techniques have been used to eliminate the need for such a separate gate-biasing voltage in current mirrors utilizing cascode-connected transistors in their output branch, such as the use of depletion mode devices, negative feedback loops or other more complex circuit techniques that are often unduly temperature dependent.

FIG. 1B presents a schematic of another set of cascode-connected transistors as used with various embodiments of the invention. FIG. 1B has a first transistor 22 and a second transistor 24. The first source/drain terminal of the first transistor 22 is coupled to a first potential node, e.g., an output voltage node $V_o$, while its second source/drain terminal is coupled to the first source/drain terminal of the second transistor 24. The second source/drain terminal of the second transistor 24 is coupled to a second potential node, e.g., a ground node. The first transistor 22 and the second transistor 24 are thus coupled in series between a first potential and a second potential.

Unlike the transistors of FIG. 1A, both the gate of the first transistor 22 and the gate of the second transistor 24 are coupled to an input voltage node $V_i$. To facilitate maintaining both the first transistor 22 and the second transistor 24 in saturation, the first transistor 22 is designed to have a threshold voltage that is lower than the threshold voltage of the second transistor 24. Neither the first transistor 22 nor the second transistor 24 are depletion mode Metal Oxide Semiconductor Field Effect Transistors (MOSFETs or simply FETs). Using this configuration, a separate biasing voltage $V_{BB}$ is not needed.

The circuit of FIG. 1A will generally exhibit a reduced output swing relative to the circuit of FIG. 1B. Current mirrors utilizing the circuit of FIG. 1A will also generally exhibit a higher compliance voltage, i.e., the minimum voltage necessary to maintain mirroring of currents between the reference branch and the output branch.

Figure 2:
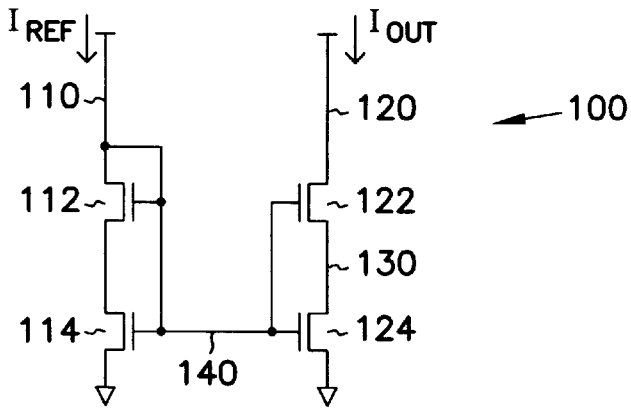
FIG. 2 is a schematic of one current mirror using Dual-$V_T$ transistors.

FIG. 2 is a schematic of one embodiment of a current mirror 100 in accordance with the invention. The current mirror 100 has a reference branch 110 and an output branch 120. The reference branch 110 has a first reference transistor 112 and a second reference transistor 114. The first source/drain terminal of the first reference transistor 112 is coupled to a high potential or reference voltage node while the second source/drain terminal of the first reference transistor 112 is coupled to the first source/drain terminal of the second reference transistor 114. The second source/drain terminal of the second reference transistor 114 is coupled to a low potential or ground node.

The output branch 120 has a first output transistor 122 and a second output transistor 124. The first source/drain terminal of the first output transistor 122 is coupled to a high potential or output voltage node while the second source/drain terminal of the first output transistor 122 is coupled to the first source/drain terminal of the second output transistor 124. The second source/drain terminal of the second output transistor 124 is coupled to a low potential or ground node. The gates of each of the transistors 112, 114, 122 and 124 are coupled to the first source/drain terminal of the first reference transistor 112 of the reference branch 110 through node 140 having a gate-bias voltage $V_B$. An intermediate voltage $V_{int}$ having a potential between the high potential and the low potential will be presented at node 130 located between the second source/drain terminal of the first output transistor 122 and the first source/drain terminal of the second output transistor 124.

The terms high potential and low potential are relative and can assume any potential levels such that current flow is as depicted in FIG. 2. For the n-type transistors depicted in FIG. 2, the first source/drain terminal represents the drain of the transistor while the second source/drain terminal represents the source of the transistor. For p-type transistors (not shown), the first source/drain terminal would represent the source of the transistor while the second source/drain terminal would represent the drain of the transistor. For current mirror applications requiring that the output current $I_{out}$ be substantially equal to the reference current $I_{ref}$, the operating characteristics, e.g., threshold voltage, of both first transistors 112 and 122 would be specified to be substantially equal and the operating characteristics of both second transistors 114 and 124 would be specified to be substantially equal. The following equations will be presented to demonstrate the properties of the cascode-connected transistors as disclosed herein and to aid discussion of their range of applicability. The subscripted reference numerals in the following equations refer generally to the transistor elements of FIG. 2.

Current flow through first output transistor 122 and second output transistor 124 of the output branch 120, i.e., $I_{out}$, are equal. Equating current flow in first output transistor 122 and second output transistor 124 gives:

$$I_{out} = \frac{K'_{124}}{2}\left(\frac{W}{L}\right)_{124}(V_B - V_{T_{124}})^2 = \frac{K'_{122}}{2}\left(\frac{W}{L}\right)_{122}(V_B - V_{int} - V_{T_{122}})^2 \quad \text{Eq. 1}$$

where: K' is the enhancement mode FET constant, $\mu_n \in / d_{ins}$, of its respective FET $\mu_n$ is the electron mobility of the bulk $\in$ is the dielectric constant of the gate dielectric $d_{ins}$ is the thickness of the gate dielectric W/L is the width to length ratio of its respective FET $V_B$ is the gate-bias voltage for each FET $V_T$ is the threshold voltage of its respective FET $V_{int}$ is the intermediate potential between the FETs Simplifying Equation 1 yields:

$$V_{int} = (V_B - V_{T_{122}}) - \alpha(V_B - V_{T_{124}}), \quad \text{Eq. 2}$$

$$\text{where } \alpha = \sqrt{\frac{K'_{124}(W/L)_{124}}{K'_{122}(W/L)_{122}}}$$

Equations 1 and 2 hold if both transistors 122 and 124 are in saturation. If the intermediate potential $V_{int}$ is high, this assumption is easily true for the first output transistor 122. For the second output transistor 124 to be in saturation, the intermediate potential $V_{int}$ must be equal to or greater than the gate-bias voltage $V_B$ minus the threshold voltage of the second output transistor 124. This constraint gives:

$$V_{int} \geqq V_B - V_{T_{124}} \quad \text{Eq.3}$$

Substituting the expression for $V_{int}$ of Equation 2 into Equation 3 gives:

$$(V_B - V_{T_{122}}) - \alpha(V_B - V_{T_{124}}) \geqq (V_B - V_{T_{124}}) \quad \text{Eq.4}$$

Thus, for second output transistor 124 to be in saturation, the following equation for gate-bias voltage applies:

$$V_B \leq \frac{(1+\alpha)V_{T_{124}} - V_{T_{122}}}{\alpha} \quad \text{Eq. 5}$$

In addition, for second output transistor 124 to be in an "on" state, its gate-to-source voltage must be greater than its threshold voltage. This constraint leads to the following range of valid gate-bias voltages, $V_B$:

$$V_{T_{124}} \le V_B \le \frac{(1+\alpha)V_{T_{124}} - V_{T_{122}}}{\alpha} \quad \text{Eq. 6}$$

Upon rearrangement, Equation 6 becomes:

$$V_{T_{124}} < V_B \le V_{T_{124}} + \frac{V_{T_{124}} - V_{T_{122}}}{\alpha} \quad \text{Eq. 7}$$

By specifying the factor α to be small, the valid range of gate-bias voltages becomes large. The value of the factor α is well within the control of the designer as can be seen upon review of Equation 2. Furthermore, by designing the factor α to be small, higher swing is available at the output of the current mirror 100.

Having given the condition for saturation of the second output transistor 124, the overall output impedance, $r_{out}$, of the cascode-connected transistors 122 and 124 is given by:

$$r_{out}=r_{DS_{122}}+r_{DS_{124}}(1+g_{m_{122}}r_{DS_{122}}) \quad \text{Eq. 8}$$

where: $r_{DS}$ is the output impedance of its respective FET $g_m$ is the transconductance of its respective FET The overall output impedance is increased because the output impedance of the second output transistor 124 is multiplied by the factor $(1+g_{m_{122}}r_{DS_{122}})$. If the second output transistor 124 were in the triode region, its output impedance would not be as large and would not lead to as much gain in the overall output impedance.

In view of the foregoing equations, it can be seen why this cascode-connected transistor topology is generally unsuited for use in single-$V_T$ technology: second output transistor 124 cannot maintain saturation without an additional gate-bias voltage applied to the gate of the first output transistor 122 if they both have the same threshold voltage. By specifying the transistors 122 and 124 in accordance with the guidance given above, with the first output transistor 122 having a lower threshold voltage than the second output transistor 124, the second output transistor 124 is able to maintain saturation without an additional gate-bias voltage, leading to increased output impedance.

Current mirrors 100 further permit higher output swings and thus lower compliance voltage. The compliance voltage, $V_{d(min)}$, is generally the lowest voltage at which the first output transistor 122 remains in saturation and is given by:

$$V_{d(min)_{122}}=V_{GS_{122}}-V_{T_{122}}=V_B-V_{int}-V_{T_{122}} \quad \text{Eq. 9}$$

Substituting the expression for $V_{int}$ of Equation 2 into Equation 9 gives:

$$V_{d(min)_{122}}=\alpha(V_B-V_{T_{122}}) \quad \text{Eq. 10}$$

By further designing the factor α to be small as disclosed above, compliance voltage is desirably reduced.

Figure 3A:
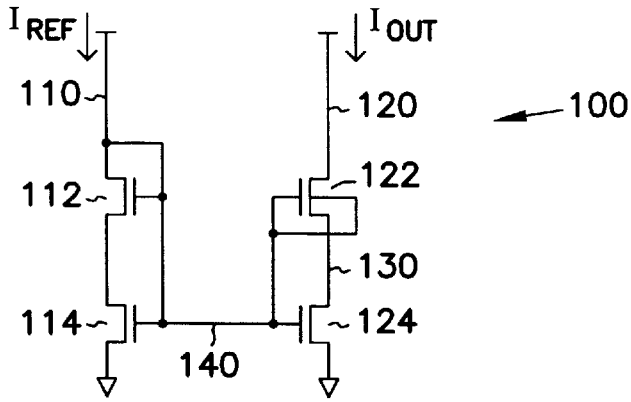
FIGS. 3A–3H are schematics of further current mirrors using body-biasing techniques.
Figure 3B:
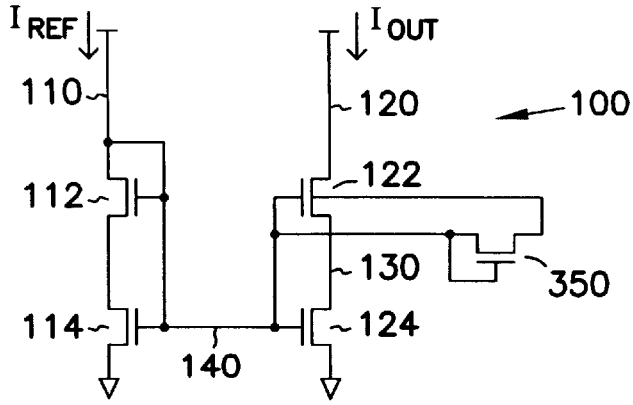

FIGS. 3A–3H are schematics of further embodiments of current mirrors 100 in accordance with the principles of the invention. The current mirrors 100 of FIGS. 3A–3B are modifications of the circuits shown in FIG. 2, as will be readily apparent, incorporating a variety of body-biasing techniques to achieve or enhance the differential threshold voltages. In FIG. 3A, the first output transistor 122 of the output branch 120 is configured as a Dynamic Threshold Voltage MOSFET (DTMOS). In DTMOS technology, the gate of the transistor is coupled to the body to moderately forward-bias the source-bulk junction and hence reduce the threshold voltage. To reduce current bled by this junction, a diode-connected transistor 350 can be coupled between the gate and body of the first output transistor 122 as shown in FIG. 3B.

Figure 3C:
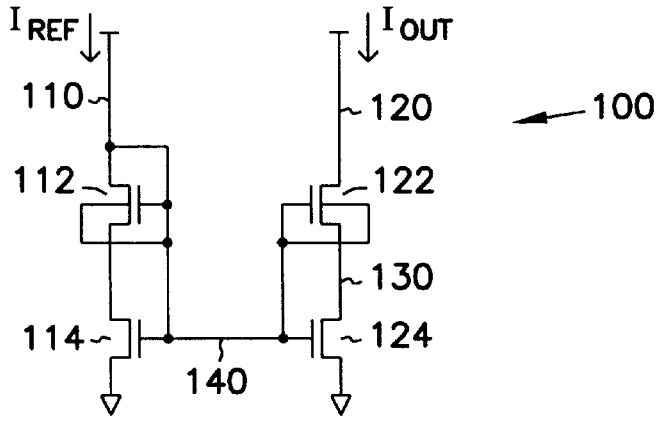
Figure 3D:
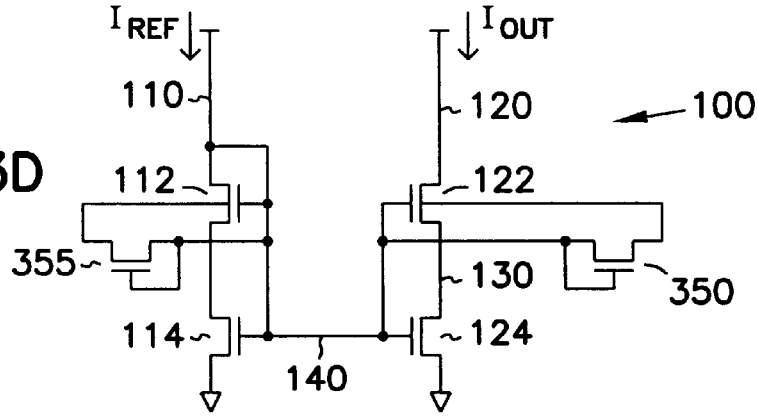

FIG. 3C depicts a variation on the circuit of FIG. 3A, where the first reference transistor 112 is further configured as a DTMOS. To reduce current bled by this source-bulk junction, a diode-connected transistor 355 can be coupled between the gate and body of the first reference transistor 112 as shown in FIG. 3D.

The circuits of FIGS. 3E–3H are similar in concept to the circuits in FIGS. 3A–3D, in that they utilize body biasing to affect the threshold voltages. In contrast, however, the circuits depicted in FIGS. 3E–3H provide the body biasing from a potential source other than the gate potential.

Figure 3E:
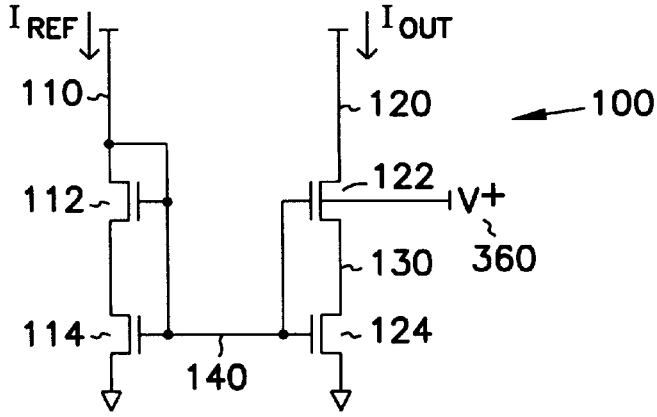
Figure 3F:
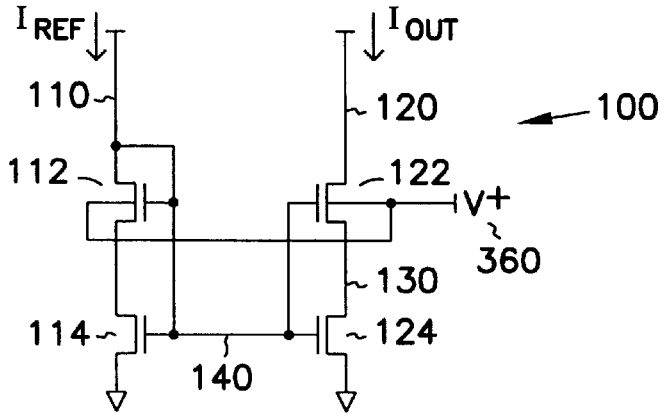

In FIG. 3E, a positive potential from potential node 360 is coupled to the body of the first output transistor 122 to provide a DTMOS-like effect. The positive potential from potential node 360 thus reduces the threshold voltage of the first output transistor 122. In FIG. 3F, the positive potential from potential node 360 is further coupled to the body of the first reference transistor 112, thus reducing the threshold voltage of the first reference transistor 112.

Figure 3G:
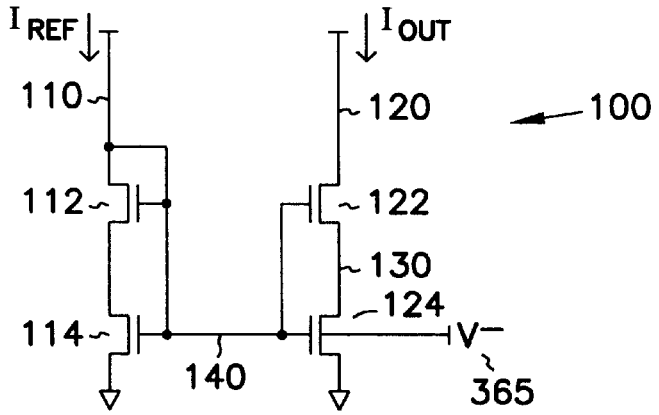
Figure 3H:
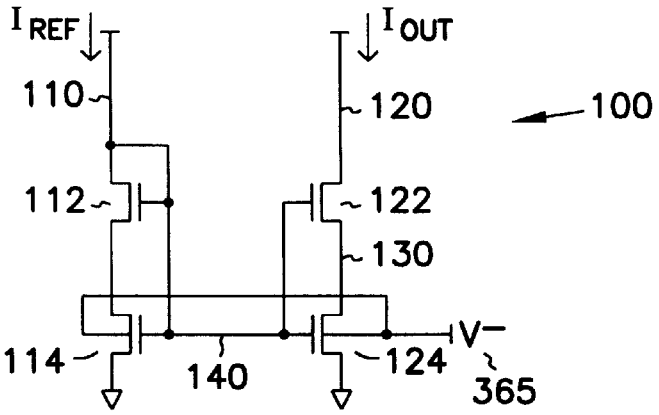

In FIG. 3G, a negative potential from potential node 365 is coupled to the body of the second output transistor 124 to provide a DTMOS-like effect. The negative potential from potential node 365 thus increases the threshold voltage of the second output transistor 124. In FIG. 3H, the negative potential from potential node 365 is further coupled to the body of the second reference transistor 114, thus increasing the threshold voltage of the second reference transistor 114. Negative potentials of the type used herein can be generated using charge pumps or other similar techniques. Generation of negative potentials using charge pumps is well understood in the art.

The body-biasing techniques can be combined in a variety of fashions, using the positive biasing of FIGS. 3A–3F in combination with the negative biasing of FIGS. 3G–3H to enhance the threshold voltage differential. As one example, the positive bias received by the body of the first transistor 122, as shown in FIG. 3A, can be used in combination with the negative bias received by the body of the second transistor 124, as shown in FIG. 3G, to further enhance the differential between threshold voltages of the first transistor 122 and the second transistor 124. Other combinations will be apparent to one skilled in the art.

In addition to the body-biasing techniques described with reference to FIGS. 3A–3H, physical characteristics of the transistors can further be varied to enhance the threshold voltage differential. As an example, channel length can be varied to correspondingly vary the threshold voltage of a transistor. However, the user is warned that second-order effects may produce an undesirable change in threshold voltage.

Normally, diffusion of the source and drain implants causes Short-Channel Effect (SCE), a decrease in inversion field magnitude and a consequent decrease in threshold voltage. Damage caused by the implantation process may cause inhomogeneous diffusion of dopant in the channel, thus increasing, rather than decreasing, the inversion field magnitude near the source and drain. This is Reverse SCE (RSCE). Impurities in the channel region can produce a like effect. As a result, threshold voltage may increase with decreasing channel length. Eventually, as channel length is further reduced, SCE dominates and the threshold voltage begins to decrease again.

Figure 4A:
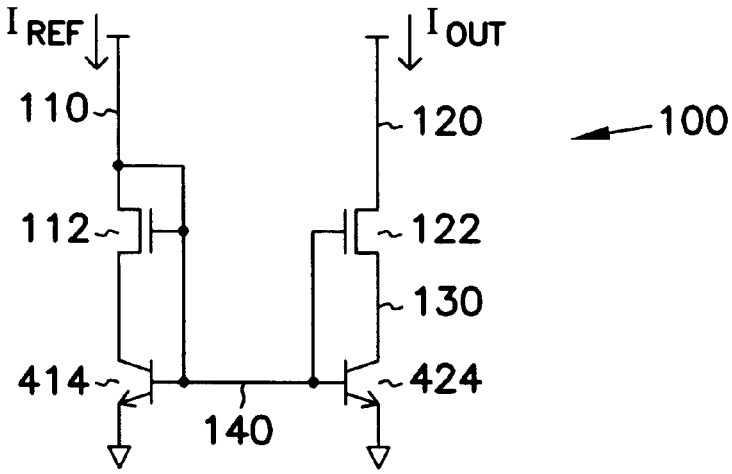
FIGS. 4A–4B are schematics of still further current mirrors using BiCMOS technology.
Figure 4B:
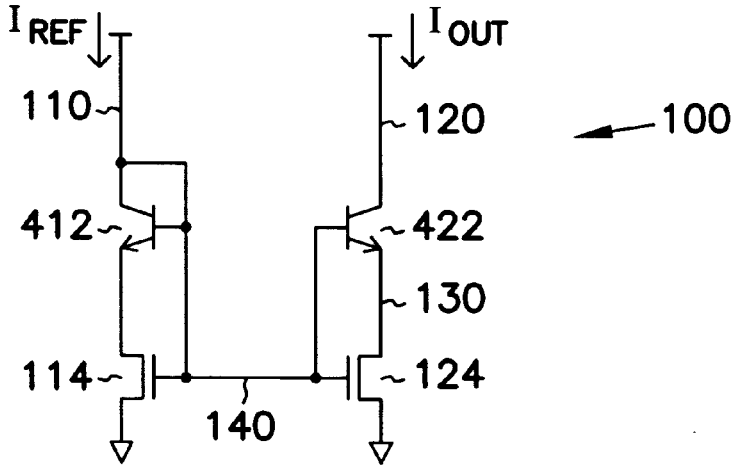

FIGS. 4A and 4B are schematics of still further embodiments of current mirrors 100 in accordance with the principles of the invention. The current mirrors 100 of FIGS. 4A–4B are modifications of the circuits shown in FIG. 2, as will be readily apparent. As shown in FIGS. 4A–4B, the idea of dual-$V_T$ cascoding can be implemented in Bipolar Complementary Metal Oxide Semiconductor (BiCMOS) technology, a combination of bipolar and MOS technologies, by using a cascode connection of a bipolar transistor and an enhancement mode transistor. If the bipolar turn-on voltage were larger than the threshold voltage of the enhancement mode transistor, the bipolar transistors 414 and 424 would replace second transistors 114 and 124, respectively, as shown in FIG. 4A. Conversely, if the bipolar turn-on voltage were smaller than the threshold voltage of the enhancement mode transistor, the bipolar transistors 412 and 422 would replace first transistors 112 and 122, respectively, as shown in FIG. 4B. As shown in FIGS. 4A–4B, the base, collector and emitter of the bipolar transistors would be coupled as were the gate, first source/drain terminal and second source/drain terminal, respectively, of the enhancement mode transistors they replaced.

Figure 5:
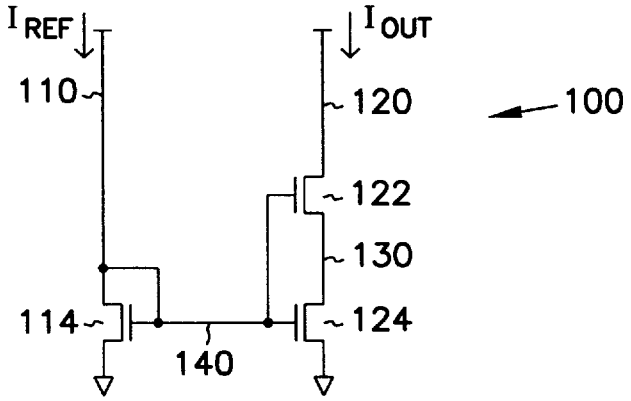
FIG. 5 is a schematic of a current mirror showing a reduction in transistor usage.

FIG. 5 is a schematic of yet another embodiment of a current mirror 100 in accordance with the principles of the invention. In FIG. 5, first reference transistor 112 may be eliminated in order to reduce the number of transistors required to fabricate a current mirror 100. For this embodiment, the gates of the transistors 114, 122 and 124 are all coupled to the first source/drain terminal of the reference transistor 114 through node 140. While FIG. 5 depicts an output branch 120 in accordance with the current mirror 100 of FIG. 2, this embodiment could be combined with other output branches 120 in accordance with the current mirrors 100 of FIGS. 3A–3B, 3E, 3G and 4A–4B. Furthermore, the body of reference transistor 114 can be coupled to a negative potential as shown in FIG. 3H.

Figure 6:
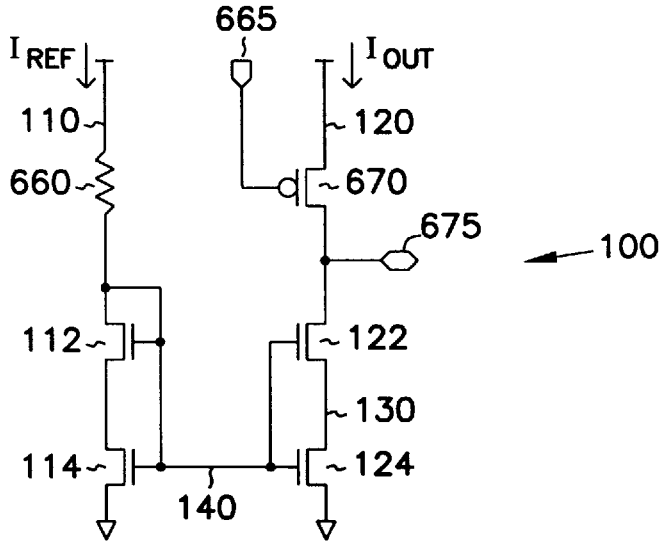
FIG. 6 is a schematic of a current mirror functioning as an active load.

FIG. 6 is a schematic of an embodiment of a current mirror 100 functioning as an active load. The current mirror 100 of FIG. 6 generally takes the form of the current mirror 100 of FIG. 2. However, it should be readily apparent that any current mirror in accordance with the embodiments disclosed herein may be substituted. As one example, the current mirror 100 of FIG. 6 is depicted as an active load for a PMOS amplifier.

As shown in FIG. 6, a resistance 660 is coupled in the reference branch 110 to set the reference current $I_{ref}$. The PMOS amplifier contains a p-channel transistor 670 whose first source/drain terminal and second source/drain terminal are coupled across the output branch 120, an amplifier input 665 coupled to the gate of the p-channel transistor 670 and an amplifier output 675 coupled between the second source/drain terminal of the p-channel transistor 670 and the first source/drain terminal of the first output transistor 122.

Figure 7:
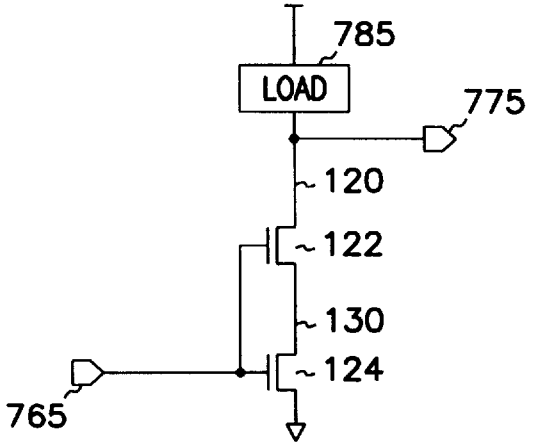
FIG. 7 is a schematic of a cascode amplifier using Dual-$V_T$ transistors.

FIG. 7 shows how the cascoding of Dual-$V_T$ transistors can be adapted as a cascode amplifier. The cascode amplifier utilizes an output branch of the current mirrors of the various embodiments as described herein. While FIG. 7 depicts an output branch in accordance with the current mirror 100 of FIG. 2, various embodiments of the cascode amplifier could utilize other output branches in accordance with the current mirrors 100 of FIGS. 3A–3B, 3E, 3G and 4A–4B.

The gate of the first transistor 122 is coupled to the gate of the second transistor 124 and an amplifier input 765. The first source/drain terminal of the first transistor 122 is coupled in parallel to an amplifier output 775 and a load, the load being further coupled to a high potential node. The second source/drain terminal of the first transistor 122 is coupled to the first source/drain terminal of the second transistor 124. The second source/drain terminal of the second output transistor 124 is coupled to a low potential or ground node.

Cascode amplifiers of the type described with reference to FIG. 7 benefit from the high output impedance and high swing provided by the cascode-connected Dual-$V_T$ transistors. Cascode amplifiers utilizing transistors having substantially the same threshold voltage and a separate bias for the first transistor, e.g., as shown in FIG. 1A, will exhibit a lower swing.

Current mirrors and amplifiers as disclosed herein are capable of providing high swing and high output impedance without the need for an additional gate-bias voltage or depletion mode devices. The current mirrors as disclosed herein are suited for applications requiring a regulated current and for applications as active loads.

Although specific embodiments have been illustrated and described herein, it will be appreciated by those of ordinary skill in the art that any arrangement which is calculated to achieve the same purpose may be substituted for the specific embodiments shown. Many adaptations of the invention will be apparent to those of ordinary skill in the art. As an example, the n-channel FETs depicted in the foregoing embodiments could be replaced by p-channel FETs, and vice versa, given appropriate changes in signal characteristics. Accordingly, this application is intended to cover any adaptations or variations of the invention. It is manifestly intended that this invention be limited only by the following claims and equivalents thereof.

What is claimed is:

1. A current mirror, comprising:

a first output transistor having a gate, a first source/drain terminal and a second source/drain terminal and having a first threshold voltage, wherein the first source/drain terminal of the first output transistor is coupled to a first potential node; and a second output transistor having a gate, a first source/drain terminal and a second source/drain terminal and having a second threshold voltage, wherein the first source/drain terminal of the second output transistor is coupled to the second source/drain terminal of the first output transistor and the second source/drain terminal of the second output transistor is coupled to a second potential node, further wherein the second threshold voltage is higher than the first threshold voltage, the gate of the first output transistor is coupled to the gate of the second output transistor, and at least one of the first and second output transistors receives a body bias.

2. The current mirror of claim 1, wherein a body of the first output transistor receives a positive bias.

3. The current mirror of claim 2, wherein the gate of the first output transistor is further coupled to the body of the first output transistor to provide the positive bias.

4. The current mirror of claim 3, wherein a diode-connected transistor is coupled between the gate and the body of the first output transistor.

5. The current mirror of claim 1, wherein a body of the second output transistor receives a negative bias.

6. The current mirror of claim 1, further comprising:

a first reference transistor having a gate, a first source/drain terminal and a second source/drain terminal and having a third threshold voltage, wherein the first source/drain terminal of the first reference transistor is coupled to a third potential node; and a second reference transistor having a gate, a first source/drain terminal and a second source/drain terminal and having a fourth threshold voltage, wherein the first source/drain terminal of the second reference transistor is coupled to the second source/drain terminal of the first reference transistor and the second source/drain terminal of the second reference transistor is coupled to a fourth potential node, further wherein the fourth threshold voltage is higher than the third threshold voltage;

wherein the gate of the first reference transistor is coupled to the first source/drain terminal of the first reference transistor, the gate of the second reference transistor, the gate of the first output transistor and the gate of the second output transistor.

7. The current mirror of claim 6, wherein the first threshold voltage and the third threshold voltage are substantially equal and the second threshold voltage and the fourth threshold voltage are substantially equal.

8. The current mirror of claim 6, wherein the second potential and the fourth potential are ground nodes.

9. A current mirror, comprising:

an enhancement mode output transistor having a gate, a first source/drain terminal and a second source/drain terminal and having a threshold voltage, wherein the first source/drain terminal of the enhancement mode output transistor is coupled to a first potential node; and a bipolar output transistor having a base, a collector and an emitter and having a turn-on voltage, wherein the collector of the bipolar output transistor is coupled to the second source/drain terminal of the enhancement mode output transistor and the emitter of the bipolar output transistor is coupled to a second potential node, further wherein the turn-on voltage of the bipolar output transistor is higher than the threshold voltage of the enhancement mode output transistor;

wherein the gate of the enhancement mode output transistor is coupled to the base of the bipolar output transistor.

10. The current mirror of claim 9, wherein a body of the enhancement mode output transistor receives a positive bias.

11. The current mirror of claim 10, wherein the gate of the enhancement mode output transistor is further coupled to the body of the enhancement mode output transistor to provide the positive bias.

12. The current mirror of claim 11, wherein a diode-connected transistor is coupled between the gate and the body of the enhancement mode output transistor.

13. The current mirror of claim 9, further comprising:

an enhancement mode reference transistor having a gate, a first source/drain terminal and a second source/drain terminal and having a threshold voltage, wherein the first source/drain terminal of the enhancement mode reference transistor is coupled to a first potential node; and a bipolar reference transistor having a base, a collector and an emitter and having a turn-on voltage, wherein the collector of the bipolar reference transistor is coupled to the second source/drain terminal of the enhancement mode reference transistor and the emitter of the bipolar reference transistor is coupled to a second potential node, further wherein the turn-on voltage of the bipolar reference transistor is higher than the threshold voltage of the enhancement mode reference transistor;

wherein the gate of the enhancement mode reference transistor is coupled to the first source/drain terminal of the enhancement mode reference transistor, the base of the bipolar reference transistor, the base of the bipolar output transistor and the gate of the enhancement mode output transistor.

14. A current mirror, comprising:

a bipolar output transistor having a base, a collector and an emitter and having a turn-on voltage, wherein the collector of the bipolar output transistor is coupled to a first potential node; and an enhancement mode output transistor having a gate, a first source/drain terminal and a second source/drain terminal and having a threshold voltage, wherein the first source/drain terminal of the enhancement mode output transistor is coupled to the emitter of the bipolar output transistor and the second source/drain terminal of the enhancement mode output transistor is coupled to a second potential node, further wherein the threshold voltage of the enhancement mode output transistor is higher than the turn-on voltage of the bipolar output transistor;

wherein the gate of the enhancement mode output transistor is coupled to the base of the bipolar output transistor.

15. The current mirror of claim 14, further comprising:

a bipolar reference transistor having a base, a collector and an emitter and having a turn-on voltage, wherein the collector of the bipolar reference transistor is coupled to a third potential node and the base of the bipolar reference transistor is coupled to the collector of the bipolar reference transistor; and an enhancement mode reference transistor having a gate, a first source/drain terminal and a second source/drain terminal and having a threshold voltage, wherein the first source/drain terminal of the enhancement mode reference transistor is coupled to the emitter of the bipolar reference transistor and the second source/drain terminal of the enhancement mode reference transistor is coupled to a fourth potential node, further wherein the threshold voltage of the enhancement mode reference transistor is higher than the turn-on voltage of the bipolar reference transistor;

wherein the gate of the enhancement mode reference transistor is coupled to the base of the bipolar reference transistor.

16. The current mirror of claim 14, wherein the enhancement mode output transistor receives a negative body bias.

17. A current mirror, comprising:

a reference branch, comprising:

a first reference transistor having a gate, a first source/drain terminal and a second source/drain terminal; and an output branch, comprising:

a first output transistor having a gate, a first source/drain terminal and a second source/drain terminal and having a first threshold voltage, wherein the first source/drain terminal of the first output transistor is coupled to a first potential node; and a second output transistor having a gate, a first source/drain terminal and a second source/drain terminal and having a second threshold voltage, wherein the first source/drain terminal of the second output transistor is coupled to the second source/drain terminal of the first output transistor and the second source/drain terminal of the second output transistor is coupled to a second potential node, further wherein the second threshold voltage is higher than the first threshold voltage;

wherein the gates of the first reference transistor, the first output transistor and the second output transistor are coupled to the first source/drain terminal of the first reference transistor; and wherein at least one of the first output transistor and the second output transistor receives a body bias.

18. The current mirror of claim 17, wherein a body of the first output transistor receives a positive bias.

19. The current mirror of claim 18, wherein the gate of the first output transistor is further coupled to the body of the first output transistor to provide the positive bias.

20. The current mirror of claim 19, wherein a diode-connected transistor is coupled between the gate and the body of the first output transistor.

21. The current mirror of claim 17, wherein a body of the second output transistor receives a negative bias.

22. The current mirror of claim 17, further comprising:

a second reference transistor having a gate, a first source/drain terminal and a second source/drain terminal;

wherein the first source/drain terminal of the second reference transistor is coupled to the second source/drain terminal of the first reference transistor; and wherein the gate of the second reference transistor is coupled to the gates of the first reference transistor, the first output transistor and the second output transistor.

23. A cascode amplifier, comprising:

a first transistor having a gate, a first source/drain terminal and a second source/drain terminal and having a first threshold voltage, wherein the first source/drain terminal of the first transistor is coupled to a load and an amplifier output in parallel, wherein the load is further coupled to a first potential node; and a second transistor having a gate, a first source/drain terminal and a second source/drain terminal and having a second threshold voltage, wherein the first source/drain terminal of the second transistor is coupled to the second source/drain terminal of the first transistor and the second source/drain terminal of the second transistor is coupled to a second potential node, further wherein the second threshold voltage is higher than the first threshold voltage, still further wherein the gate of the first transistor is coupled to the gate of the second transistor and an amplifier input;

wherein a body of the first transistor receives a positive bias.

24. The cascode amplifier of claim 23, wherein the gate of the first transistor is further coupled to the body of the first transistor to provide the positive bias.

25. The cascode amplifier of claim 24, wherein a diode-connected transistor is coupled between the gate and the body of the first transistor.

26. A cascode amplifier, comprising:

a first transistor having a gate, a first source/drain terminal and a second source/drain terminal and having a first threshold voltage, wherein the first source/drain terminal of the first transistor is coupled to a load and an amplifier output in parallel, wherein the load is further coupled to a first potential node; and a second transistor having a gate, a first source/drain terminal and a second source/drain terminal and having a second threshold voltage, wherein the first source/drain terminal of the second transistor is coupled to the second source/drain terminal of the first transistor and the second source/drain terminal of the second transistor is coupled to a second potential node, further wherein the second threshold voltage is higher than the first threshold voltage, still further wherein the gate of the first transistor is coupled to the gate of the second transistor and an amplifier input;

wherein a body of the second transistor receives a negative bias.

27. A cascode amplifier, comprising:

an enhancement mode transistor having a gate, a first source/drain terminal and a second source/drain terminal and having a threshold voltage, wherein the first source/drain terminal of the enhancement mode transistor is coupled to a load and an amplifier output in parallel, wherein the load is further coupled to a first potential node; and a bipolar transistor having a base, a collector and an emitter and having a turn-on voltage, wherein the collector of the bipolar transistor is coupled to the second source/drain terminal of the enhancement mode transistor and the emitter of the bipolar transistor is coupled to a second potential node, further wherein the turn-on voltage of the bipolar transistor is higher than the threshold voltage of the enhancement mode transistor;

wherein the gate of the enhancement mode transistor is coupled to the base of the bipolar transistor; and wherein the gate of the enhancement mode transistor and the base of the bipolar transistor are coupled to an amplifier input.

28. The cascode amplifier of claim 27, wherein a body of the enhancement mode transistor receives a positive bias.

29. The cascode amplifier of claim 28, wherein the gate of the enhancement mode transistor is further coupled to the body of the enhancement mode transistor to provide the positive bias.

30. The cascode amplifier of claim 29, wherein a diode-connected transistor is coupled between the gate and the body of the enhancement mode transistor.

31. A cascode amplifier, comprising:

a bipolar transistor having a base, a collector and an emitter and having a turn-on voltage, wherein the collector of the bipolar transistor is coupled to a load and an amplifier output in parallel, wherein the load is further coupled to a first potential node; and an enhancement mode transistor having a gate, a first source/drain terminal and a second source/drain terminal and having a threshold voltage, wherein the first source/drain terminal of the enhancement mode transistor is coupled to the emitter of the bipolar transistor and the second source/drain terminal of the enhancement mode transistor is coupled to a second potential node, further wherein the threshold voltage of the enhancement mode transistor is higher than the turn-on voltage of the bipolar transistor;

wherein the gate of the enhancement mode transistor is coupled to the base of the bipolar transistor; and wherein the gate of the enhancement mode transistor and the base of the bipolar transistor are coupled to an amplifier input.

32. The cascode amplifier of claim 31, wherein the enhancement mode transistor receives a negative body bias.

33. The cascode amplifier of claim 31, wherein the enhancement mode transistor is an n-channel device.

* * * * *